United States Patent [19]

Narikiyo

[11] 4,135,114

[45] Jan. 16, 1979

[54] STARTING DEVICE FOR DISCHARGE LAMP

[75] Inventor: Kenji Narikiyo, Tokyo, Japan

[73] Assignee: Hitachi, Ltd., Japan

[21] Appl. No.: 819,860

[22] Filed: Jul. 28, 1977

[30] Foreign Application Priority Data

Jul. 30, 1976 [JP] Japan ..... 51-90343

[51] Int. Cl.[2] ..... H01J 7/44; H05B 41/18

[52] U.S. Cl. ..... 315/47; 315/73; 315/74; 315/283; 315/289; 315/DIG. 2; 315/DIG. 5

[58] Field of Search ..... 315/47, 73, 74, 283, 315/289, 290, DIG. 2, DIG. 5

[56] References Cited

U.S. PATENT DOCUMENTS 2,286,789 6/1942 Dench ..... 315/47 X

*Primary Examiner*—Alfred E. Smith

*Assistant Examiner*—Charles F. Roberts

*Attorney, Agent, or Firm*—Craig & Antonelli

[57] ABSTRACT

A bimetal switch circuit, which consists of the series combination of a bimetal switch and a fixed resistance, is connected in parallel with a discharge lamp which is connected across an AC power source through an inductive ballast. The bimetal switch has a heating filament which is closed at the normal temperature and opened when heated to high temperatures by the heating filament. The total resistance value $R_o$ (in ohm) of the bimetal switch circuit at the normal temperature is set so as to establish the relation $V_s/R_o \leqq 1$ with the effective voltage $V_s$ (in volts) of the AC power source. Under such a condition, when the bimetal switch having been once opened at the starting of the discharge lamp is closed again, high-frequency high-voltage pulses are generated across both terminals of the bimetal switch circuit, and the discharge lamp is easily and stably lit up by the high-frequency pulse voltages.

7 Claims, 10 Drawing Figures

STARTING DEVICE FOR DISCHARGE LAMP

BACKGROUND OF THE INVENTION

1. Field of the Invention

This invention relates to a starting device for a discharge lamp. More particularly, it relates to a starting device which is so improved as to be suitable for the starting of a metallic vapor discharge lamp of comparatively high starting voltage, such as a high pressure mercury-vapor lamp, a metal halide-vapor lamp or a high pressure sodium-vapor lamp.

2. Description of the Prior Art

A high-pressure metallic vapor discharge lamp such as a mercury-vapor lamp, a metal halide-vapor lamp or a high pressure sodium-vapor lamp has a higher starting voltage than a low-pressure metallic vapor discharge lamp, such as a fluorescent lamp. Such contrivance is therefore required in order to start the high-pressure metallic vapor discharge lamp with a commercial AC power source (the effective voltage of which is as low as about 100–200 volts).

For example, a starting system as shown in FIG. 1 has been already proposed in order to start the mercury-vapor lamp by the use of a commercial 200-volt power source. In this system, a discharge tube 2 is connected to the commercial 200-volt power source 5 through a single choke coil ballast 1. An auxiliary electrode 8 is provided in proximity to one main electrode 7 of the discharge tube 2, and it is connected to the other main electrode 7' through a starting auxiliary resistance 9 (of about 20 kΩ).

In the case of employing the commercial 200-volt power source in this manner, the mercury-vapor lamp can be satisfactorily started even by the circuit which uses only the single choke coil ballast as illustrated in FIG. 1. In the case of employing a commercial 100-volt power source, however, effective starting is difficult to achieve with such a single choke coil system.

The metal halide-vapor lamp and the high pressure sodium-vapor lamp have a still higher starting voltage as compared to the mercury-vapor lamp described above. Therefore, they cannot be started by the foregoing single choke coil system even when the commercial 200-volt power source is used. In the case of these lamps, accordingly, special ballasts are employed which can generate voltages sufficiently higher than the available supply voltages at the time of starting. The ballasts are more complicated in construction and larger in size than the single choke coil ballast, and lead to economic disadvantages.

A starting system as shown in FIG. 2 has therefore been recently proposed for the high pressure sodium-vapor lamp. In this system, a discharge tube 2 is connected to a power source 5 through a choke coil ballast 1, and a bimetal switch 3 and a heating filament 4 are connected in series between electrodes 7 and 7' of the discharge tube 2. The bimetal switch 3 is kept closed at the normal temperature, and it is opened when heated above a certain temperature. In operation, when an AC voltage is applied from the power source 5, a current flows through a closed circuit consisting of the choke coil ballast 1, bimetal switch 3 and heating filament 4, and the heating filament 4 is red-heated. When the bimetal switch 3 is heated and opened by heat from the filament 4, a high voltage pulse P is generated in superposition on a supply voltage $V_s$ as shown in FIG. 3. Upon generation of this pulse voltage, the discharge tube 2 is fired. When the discharge tube 2 is started, the bimetal switch 3 is retained in the open state by heat which is developed by the discharge lamp itself. The height $V_p$ of the pulse voltage varies depending on the current phase at the time when the bimetal switch 3 is opened, and the highest pulse voltage $V_{p\ max}$ is produced in the case where the bimetal switch is opened at the maximum or peak value of the current. The highest pulse voltage $V_{p\ max}$ varies depending on the short-circuit current $I_s = V_s/R_H$ where $R_H$ denotes the resistance value of the heating filament 4 being red-heated by the flow of the current, and the value $V_{p\ max}$ is greater as the current $I_s$ is greater. By way of example, FIG. 4 shows the relationship between $I_s$ and $V_{p\ max}$ in the case of employing a choke coil for a mercury-vapor lamp of 400 watts.

However, the propability that the highest pulse voltage $V_{p\ max}$ will be actually attained (that is, the probability that the bimetal switch 3 will be opened when the flowing current is the maximum) is small. Usually, pulse voltages of $\frac{1}{2}$ $V_{p\ max}$ or so are often obtained. For the starting of the lamp, a higher pulse voltage $V_p$ is more effective. Ordinarily, however, the short-circuit current $I_s$ is selected within a range of 1–2 amperes, so that when the supply voltage $V_s$ is 200 volts the resistance value $R_H$ of the heating filament at the high temperature is set within a range of 100–200 ohms. When the short-circuit current $I_s$ is greater than the specified values, the pulse voltage to be generated becomes too high, and it is feared that it will result in dielectric breakdown of the choke coil ballast. Conversely, when the short-circuit current $I_s$ is smaller than the specified values, the pulse voltage to be produced becomes too low, and the effect of aiding in the starting of the discharge lamp becomes insufficient.

As the heating filament 4, which serves to heat the bimetal switch 3 and which also serves to set the value of the short-circuit current $I_s$ within the appropriate range, a tungsten filament is usually used. The reason therefor is that, in the case where $I_s$ = 1–2 amperes and $R_H$ = 100–200 ohms as stated above, the heating filament 4 must withstand heat of 200–400 watts, so a fixed resistor is unreasonable in capacity. When the resistance $R_H$ of the tungsten filament at the high temperature is made 100–200 ohms, the resistance $R_o$ thereof at the normal temperature is at most about 2–3 ohms.

The starting system illustrated in FIG. 2 has the following disadvantages. Firstly, as previously stated, in the case where the bimetal switch is opened in the phase in which the short-circuit current is small, a sufficiently high pulse voltage is not produced, so that the discharge lamp is not always started by one operation of the bimetal switch. In particular, a discharge lamp, such as the metal halide-vapor lamp which exhibits a delay of several hundreds of milliseconds from the application of a voltage to the initiation of arc discharge, requires 5–6 switching operations before starting in many cases. Therefore, a long time is required for the starting. Secondly, in the case where the height $V_p$ of the pulse voltage generated at the opening of the bimetal switch is small and therefore the discharge lamp cannot be started, the bimetal switch is cooled and closed again, and at this time, the contact element of the switch gives rise to a chattering phenomenon. Pulse voltages generated by the chattering phenomenon are much higher than the voltage $V_p$ generated at the opening of the bimetal switch, and reach 20–30 kilovolts. In the case where the discharge lamp is normal, the pulse voltages generated by the chattering phenomenon of the switch cannot piece are absorbed by the action of the discharge lamp as a discharge gap and therefore do no harm. However, in the case where the starting voltage of the discharge lamp has become high at the last stage of the lifetime of the lamp or by any other cause, the discharge lamp no longer functions as a good discharge gap. In such case, accordingly, the high pulse voltages as discharged above cannot be absorbed, and it is possible that dielectric breakdown of the ballast winding will result.

SUMMARY OF THE INVENTION

It is accordingly an object of this invention to provide an improved starting device which can start a high-pressure metallic vapor discharge lamp of high starting voltage, such as a mercury vapor lamp, a metal halide vapor lamp or a high-pressure sodium vapor lamp, easily and stably by the use of a commercial AC power source, which is simple in structure and low in cost and which causes few troubles.

In order to accomplish such an object, this invention provides a bimetal switch circuit which includes a bimetal switch adapted to close at the normal temperature and to open at high temperatures, and a fixed resistance element connected in series with the bimetal switch is incorporated across both terminals of a discharge tube which is connected to an AC power source through an inductive ballast. The bimetal switch is additionally provided with means for heating the switch only when a current is flowing therethrough, and the total resistance value $R_o$ (in ohms) of the bimetal switch circuit at the normal temperature and the supply voltage $V_s$ (in volts) of the AC power source are set so that a relation of $V_s/R_o \leqq 1$ may hold.

According to such a characterizing construction of this invention, immediately before the bimetal switch having once opened at the starting of the discharge tube closes again, high pulse voltages at a high frequency are generated across both the terminals of the discharge lamp, and the discharge tube is easily and stably started by the high-frequency high voltage pulses.

Objects and features of this invention other than the above-mentioned ones and further functional effects achieved thereby will become apparent as the following detailed description of exemplary embodiments proceeds.

DESCRIPTION OF THE PREFERRED EMBODIMENTS

In order to eliminate the disadvantages of the prior-art starting devices as previously stated, the inventor attempted various experiments for effecting improvements thereover. As a result, it has been found that, by connecting a fixed resistance element in series with a bimetal switch, as shown in FIG. 5, and establishing a relationship of $V_s/R_o \leqq 1$ between the supply voltage $V_s$ (in volts) and the total resistance value $R_o$ (in ohms) at the normal temperature of a bimetal switch circuit including the fixed resistance element, high-frequency high voltage pulses are generated when the bimetal switch is going to close, the high-frequency pulse voltages remarkably enhancing the effect of assisting in the starting of the discharge lamp.

Figure 5:
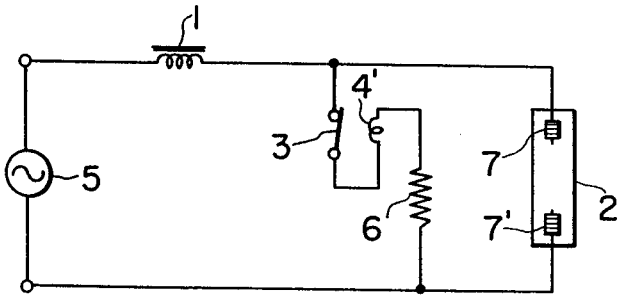
FIG. 5 is a schematic circuit diagram showing the construction of a starting device according to an embodiment of this invention.
Figure 4:
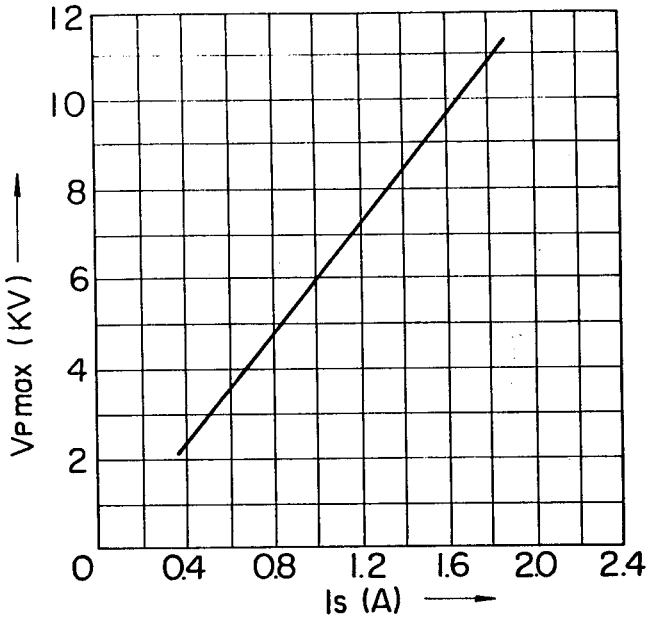
FIG. 4 is a graph showing the relationship between the current $I_s$ which flows through a bimetal switch in the starting device of FIG. 2 and the maximum value $V_{p\,max}$ of pulse voltages generated.

More specifically, FIG. 5 shows the fundamental construction of an embodiment of the starting device of this invention. In the figure, numeral 1 designates an inductive ballast, such as choke coil, numeral 2 a discharge tube equipped with electrodes 7 and 7' at both ends thereof, numeral 3 a bimetal switch adapted to close at the normal temperature and to open above a certain temperature, numeral 4' a filament for heating the bimetal, and numeral 6 a fixed resistance element having a small temperature coefficient of resistance.

The bimetal switch 3, the filament 4' and the fixed resistance element 6 are connected in series, and form a bimetal switch circuit. This bimetal switch circuit is connected in parallel with the discharge tube 2. The parallel circuit which consists of the discharge tube 2 and the bimetal switch circuit is connected to an AC power source 5 through the inductive ballast 1.

Figure 6:
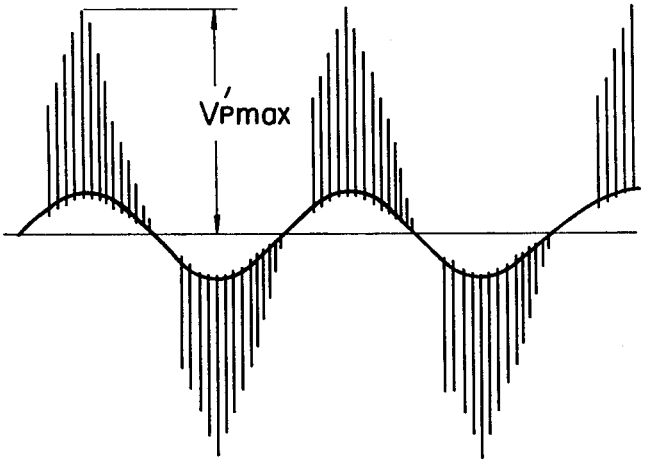
FIG. 6 is a diagram showing a voltage waveform which is applied to discharge lamps in the starting device of this invention illustrated in FIG. 5.
Figure 7:
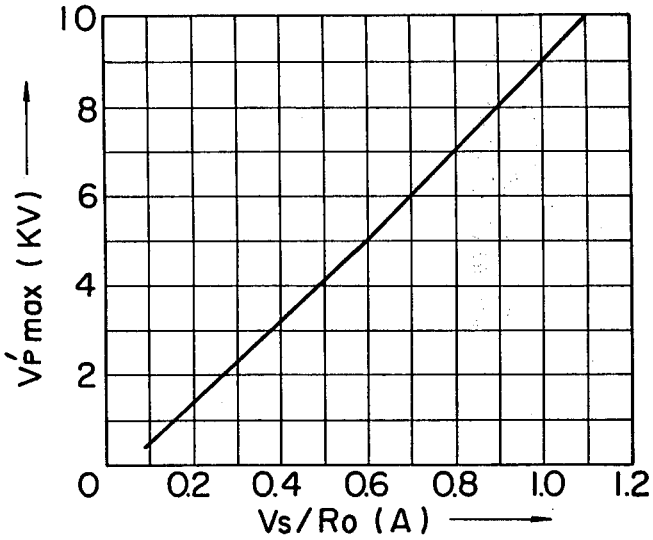
FIG. 7 is a graph showing the relationship between the ratio $V_s/R_o$ of a supply voltage $V_s$ to the total resistance value $R_o$ of a bimetal switch circuit at the normal temperature in the starting device of this invention, and the maximum value $V_{p'\,max}$ of high-frequency pulse voltages generated.

Now, the operation of the starting device will be explained. When an AC voltage from the AC power source 5 is applied to the circuit, a current flows through a closed circuit which consists of the inductive ballast 1, bimetal switch 3, filament 4' and fixed resistance element 6. The filament 4' is red-heated by this current, and the temperature of the bimetal switch 3 is raised by radiant heat from the filament 4', so that the bimetal switch 3 is opened. As in the case of the prior-art starting device shown in FIG. 2 that, th pulse voltage as illustrated in FIG. 3 is generated at the opening of the bimetal switch 3. In the case where the discharge tube 2 is not started by the single pulse voltage, no current flows through the filament 4'. Therefore, the bimetal contact piece is gradually cooled, and when it returns to the normal temperature, the switch 3 is closed again. Here, if the ratio ($V_s/R_o$) between the supply voltage $V_s$ ( in volt) and the sum of the resistance value of the fixed resistance element 6 and the resistance value of the filament 4' at the time of the normal temperature (at the time of the cooling), that is, the total electric resistance value $R_o$ (in ohm) of the bimetal switch circuit at the time of the normal temperature, is not greater than 1 (one), then high voltage pulses at high frequency as shown in FIG. 6 will be generated when the bimetal switch 4' is closed (immediately before it is prefectly closed). The pulse voltages are produced in superposition on the vicinity of a crest at every half-cycle of the supply voltage, and the state of generation of the pulse voltages continues for several hundreds milliseconds to 1 second. As indicated in FIG. 7, the maximum value $V_{p'max}$ of the pulse voltages generated at this time becomes greater as the value of the ratio $V_s/R_o$ becomes greater. Such a phenomenon of generating high-frequency pulse voltages takes place more stably as the ratio $V_s/R_o$ is smaller. The discharge tube 2 is easily and stably started by the high-frequency pulse voltages. When the discharge tube 2 has reached a stable lighting state, the bimetal switch 3 is held in the open state by heat radiated from the discharge tube itself.

Figure 1:
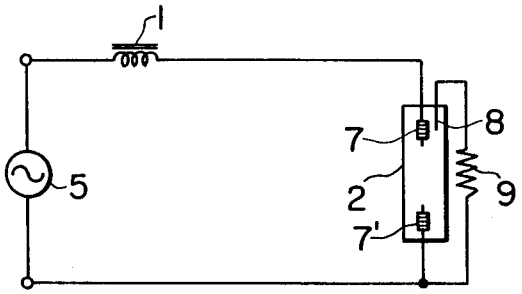
FIG. 1 PRIOR ART
FIG. 1 is a schematic circuit diagram showing an example of a prior-art starting device for a mercury-vapor lamp.
Figure 2:
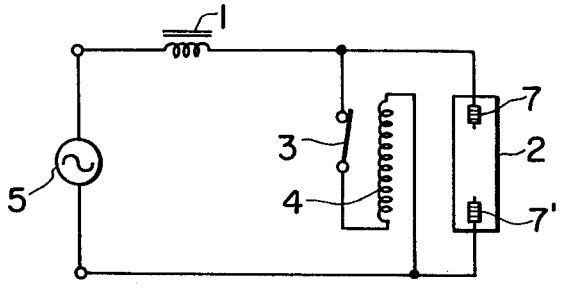
FIG. 2 PRIOR ART
FIG. 2 is a schematic circuit diagram showing an example of a prior-art starting device for a high pressure sodium-vapor lamp.
Figure 3:
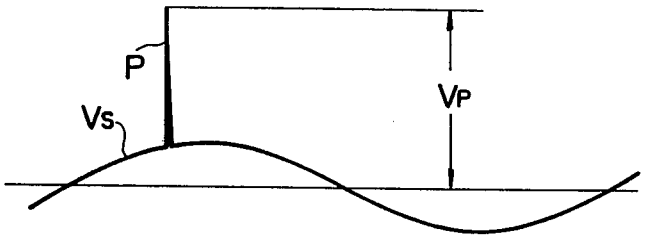
FIG. 3 is a diagram showing a voltage waveform which is applied to the discharge tube in the starting device of FIG. 2.

On the other hand, such phenomenon is difficult to achieve in the case of using only the filament 4 and employing no fixed resistance element as illustrated in FIG. 2. The reason therefor is that the resistance value of the filament 4 at the time when it has returned to the normal temperature due to the zero current is as small as about several ohms, with the result that the value $V_s/R_o$ is too great.

As the starting device, it is desirable that the high-frequency pulse voltages generated at the closure of the bimetal switch 3 have appropriate heights, that the generation of the pulse voltages is stable, that the generating period of time of the high-frequency voltages is long, and that the device is able to withstand a long term of use. The value of the ratio $V_s/R_o$ and the design of the bimetal switch are associated with these requested characteristics. The manner of the association will now be explained. The height $V_{p'max}$ of the high-frequency pulse voltages to be generated is dependent only on the ratio $V_s/R_o$ between the supply voltage $V_s$ and the total resistance value $R_o$ of the bimetal switch circuit at the normal temperature, and the relation is as given in FIG. 7. The stability of the generation of the high-frequency pulse voltages and the length of the period of time of the generation are in a proportional relationship, and in the case where the generation is stable, the period of time thereof is long. This is associated with the design of the bimetal.

Description will now be made of the relation between the design dimensions of the bimetal and the stability of the phenomenon of the generation of the high-frequency voltages. By way of example, consider a bimetal switch wherein a contact of, e.g., tungsten is provided at the fore end of a rectangular bimetal plate which is fixed on the side remote from the contact and which has an effective length L (mm), a thickness h (mm), a width b (mm) and an elastic coefficient E (kg/mm$^2$). It is known that the natural frequency of the bimetal plate is proportional to the square root of the spring constant k thereof, $$\sqrt{k} = \sqrt{\frac{E \cdot b \cdot h^3}{4L^3}}.$$

Figure 8:
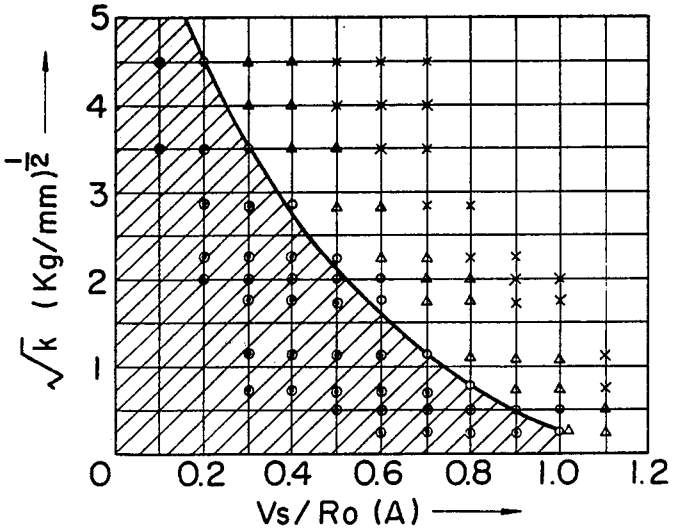
FIG. 8 is a graph showing the stable operating range of the starting device of this invention in relation to the foregoing ratio $V_s/R_o$ and to the square root $\sqrt{k}$ of the spring constant of a bimetal contact piece.

Experiments were conducted on the stabilities of the generation of the high-frequency pulse voltages by variously changing the value $\sqrt{k}$ and the foregoing value $V_s/R_o$, and the results are illustrated in FIG. 8. In this figure, mark X indicates that the generation of the high-frequency pulse voltages is scarcely noted, and mark Δ that the generation of the high-frequency pulse voltages is unstable and that when the switching operations of the bimetal switch 3 are repeated many times, the number of times of generations of the high-frequency pulse voltages is at most 50% of the number of times of the switching operations. Mark O denotes that the high-frequency pulse voltages are generated about 80% of the number of times of the switching operations of the bimetal switch 3, and mark  indicates that the high-frequency pulse voltages are stably generated substantially 100%. As the starting device of this invention, it is desirable that the high-frequency pulse voltages are generated as stably as possible and that the parameters are set in a range hatched in FIG. 8 (a range in which the number of times of the switching operations is at least 80%). In the case where the ratio $V_s/R_o$ between the supply voltage $V_s$ and the total resistance value $R_o$ of the bimetal switch circuit at the normal temperature exceeds 1 (one), the generation of the high-frequency pulse voltages is unstable unless the value $\sqrt{k}$ is made extremely small. Even when the bimetal plate has any other shape, the relationship exhibits the same tendency as in FIG. 8 though the numerical value of the quantity $\sqrt{k}$ is somewhat different.

Regarding the life, the fusion of the contact of the bimetal switch is the most problematic, and it must be prevented to the utmost. It is also important that the value of the ratio $V_s/R_o$ is not made greater than is required. When the value $V_s/R_o$ becomes greater than 1 (one), the phenomenon of the generation of the high-frequency pulse voltages is difficult to produce as stated previously, and besides, the current flowing through the bimetal switch becomes great, so that the prevention of the fusion of the bimetal switch contact becomes difficult. Therefore, the performance as the starting device to which this invention is devoted cannot be satisfactorily demonstrated.

By all accounts, the value of the ratio $V_s/R_o$ should most desirably be set at 0.1–0.6. In FIG. 5, the filament 4', which is disposed in the vicinity of the bimetal contact piece of the bimetal switch 3, reaches a high temperature owing to the current flowing through the bimetal switch circuit, and it supplies heat to the bimetal contact piece so as to open the bimetal switch 3. It is made of a metal difficult to fuse, such as tungsten. The resistance value of the filament at the normal temperature is less than about 2–3 Ω, and this resistance value is included in the foregoing resistance value $R_o$.

The filament 4' for heating the bimetal is not the basic requirement of this invention. Any expedient may be adopted so long as the bimetal switch 3 which is closed at the normal temperature can be heated and opened by the current flowing through the bimetal switch circuit, or by any other suitable means when the current is flowing. By way of example, it is possible to utilize self-heating owing to the current which flows through the bimetal contact piece, or there may be separately provided suitable heating means which is so constructed as to heat the bimetal contact piece in synchronism with the current when it is flowing through the bimetal contact piece. In such case, the filament 4' is unnecessary. The resistance value at the normal temperature of the resistance element 6 in FIG. 5 forms the main component of the total resistance value $R_o$ of the bimetal switch circuit at the normal temperature, and the resistance element 6 is the fundamental constituent of this invention. When the resistance element 6 has come to the end of its life under the short-circuited state, a state in which merely the ballast 1 is directly coupled to the power source 5 is established. Consequently, a very great short-circuit current flows through the bimetal switch circuit. Since the great current is cut off by the opening of the bimetal switch 3 or the disconnection of the filament 4', the generation of an excessive pulse voltage is feared. It is accordingly preferable to employ as the resistance element 6 one which is comparatively small in the temperature coefficient of resistance as stated previously, and besides, which comes to the end of its life under a state of an increased resistance value as in, for example, an oxide film resistance or a carbon film resistance. It is the fundamental requisite of this invention that the ballast 1 is an inductive one. With only a pure resistance ballast, the desired pulse voltages are not generated, and the object of this invention is not achieved. However, even in the case of employing a pure resistance ballast, the same effect is obtained in view of the subject matter of this invention when it is combined with an inductive element. Such a modification shall be covered within the scope of this invention.

Examples of this invention will now be described.

EXAMPLE 1

In the circuit arrangement shown in FIG. 5, the dimensions and physical characteristics of the contact piece of the bimetal switch 3 were as follows:

thickness h: 0.25 mm,
Length L: 15.0 mm (cantilever at one end),
Width: 3.0 mm,
Curve constant: $11.8 \times 10^{-6}/°$ C,
Elastic constant: $1.7 \times 10^4$ kg/mm$^2$,
Bimetal switch separating temperature: 100° C.,
Bimetal switch contact: 0.8 $\phi$, pure tungsten bar.

The fixed resistance element 6 was an oxide film resistor whose resistance value at the normal temperature was 560 Ω and which had a continuous load capacity of 5 W and could withstand up to 75 W for about 30 seconds. The dimensions of the fixed resistance were 8 $\phi$ mm in diameter × 50 mm in length. The bimetal heating filament 4' was a duplex-wound coil of tungsten wire. In the circuit arrangement of FIG. 5, when the AC supply voltage was 200 V, the current flowing through the bimetal switch circuit was about 0.3 A, the power dissipated in the filament 4' by the current was about 10 W, and the power dissipated in the fixed resistance element 6 was about 50 W. The bimetal contact piece and the filament 4' were disposed at a distance of about 5 mm. The parts thus far described were connected to the luminous tube 2 of a 400-W metal halide-vapor lamp (employing thallium iodide, dysprosium iodide, mercury and argon gas as filling substances) as shown in FIG. 5. The luminous tube 2 and the bimetal switch circuit portion were contained in an envelope made of hard glass. The interior of the envelope was evacuated to a vacuum, and the discharge tube was connected through a choke coil ballast 1 for a 400-W mercury-vapor lamp to an AC power source 5 of 50 Hz whose output voltage was variable. In this case, the supply voltage required for the starting of the luminous tube 2 was about 160 V at an ambient temperature of 20° C., and was about 170 V at an ambient temperature of 0° C. By tests employing the bimetal switches of various dimensions, it has been confirmed that in the case of setting the value $V_s/R_o$ within the most desirable range of 0.1–0.6 as stated previously, appropriately the dimensions of the bimetal are selected from within a range of 0.2–0.4 mm for the thickness h, a range of 10–60 mm for the length L and a range of 2–8 mm for the width b. Of course, as previously stated, even when the dimensions fall outside the ranges, a sufficient effect of aiding in the starting can be achieved as long as the relationship $V_s/R_o \leqq 1$ is held.

Figure 9:
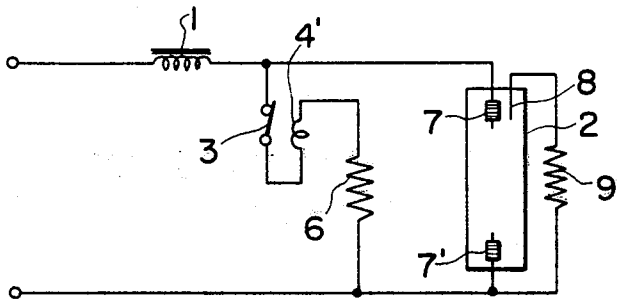
FIG. 9 is a schematic circuit diagram showing the construction of a starting device according to another embodiment of this invention.

In the example, the experiments were conducted on the luminous tube 2 which had only the main electrodes 7 and 7' as shown in FIG. 5. It is a matter of course, however, that more favorable results can be obtained in case of applying this invention to a luminous tube 2 wherein, as shown in FIG. 9, an auxiliary electrode 8 is provided in the vicinity of one electrode 7 and is connected to the other electrode 7' through a starting auxiliary resistance 9.

EXAMPLE 2

The same bimetal switch circuit as described in Example 1 was connected as shown in FIG. 5 and was inserted into an envelope made of glass along with the luminous tube 2 of the so-called high pressure sodium-vapor lamp type (400 W) in which an alumina ceramics tube was filled with sodium, mercury and xenon gas. The interior of the envelope was evacuated to a vacuum, and was connected through a choke coil for a mercury-vapor lamp (400 W) to an AC power source 5 whose output voltage was variable. In this case, the supply voltage required for the starting of the luminous tube 2 was about 170 V in a wide range of ambient temperatures of 0° C.–50° C.

As apparent from the embodiments described above, the starting device according to this invention employs a bimetal switch circuit. In order to protect the bimetal switch and to maintain the open state of the bimetal switch after the lighting of the lamp, therefore, it is desirable to use the starting device under the state under which the bimetal switch circuit portion is assembled in the envelope accommodating the discharge tube therein and under which the interior of the envelope is evacuated to a vacuum.

Figure 10:
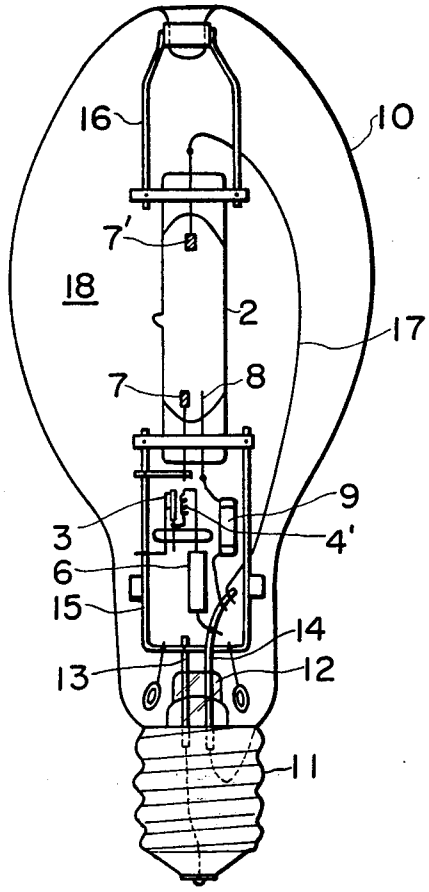
FIG. 10 is a schematic structural view showing the state in which a bimetal switch circuit portion in the starting device of this invention is assembled in an envelope of a metal halide-vapor lamp along with a luminous tube.

FIG. 10 shows the situation in which the bimetal switch circuit portion in the starting device of this invention is assembled in the envelope of a metal halide-vapor lamp. In the figure, numeral 2 designates a luminous tube of the metal halide-vapor lamp, numeral 10 the envelope made of glass, and numeral 11 a base. The luminous tube 2 is held at a central part in the envelope 10 by a supporting frame 15 which is fixed to lead-in wires 13 and 14 planted in a stem 12 and a supporting frame 16 which is provided at the top part of the envelope 10. The internal space 18 of the envelope 10 is evacuated to a vacuum. One main electrode 7 of the luminous tube 2 is connected to one lead-in wire 13 through the supporting frame 15, while the other main electrode 7' is connected to the other lead-in wire 14 through a tungsten wire 17. In the vicinity of the one main electrode 7, an auxiliary electrode 8 is provided, which is connected to the lead-in wire 14 through a resistor 9 for aiding in the starting. The bimetal switch circuit which is a series circuit consisting of a bimetal switch 3, a bimetal heating filament 4' and a fixed resistance element 6 is provided between the luminous tube 2 and the stem 12, and one end of which is connected to the lead-in wire 13 through the supporting frame 15 and the other end to the lead-in wire 14. The lead-in wires 13 and 14 are taken out of the envelope 10 by penetrating through the stem 12, and are connected to respective terminals of the base 11. In use, an AC power source is connected across both the terminals of the base 11 through an inductive ballast.

As understood from the above detailed description, according to the starting device of this invention, even the metal halide-vapor lamp, the high pressure sodium-vapor lamp containing xenon gas, etc. which have heretofore required special ballasts in order to start with a commercial AC power source can be easily and stably started by the use of such a conventional ballast as has hitherto been used for the mercury-vapor lamp. Therefore, the starting device of this invention is remarkably great in the economical effect produced.

I claim:

1. A starting device for a discharge lamp comprising a bimetal switch circuit including a bimetal switch which is closed at a normal temperature and opened at a high temperature and a fixed resistance element connected in series therewith, a discharge tube, said switch circuit being connected across both terminals of said discharge tube, an inductive ballast, and an AC power source connected through said inductive ballast across said discharge tube, and the total resistance value $R_o$ (in ohms) of said bimetal switch circuit at the normal temperature and the supply voltage $V_s$ (in volts) having the relation $V_s/R_o \leqq 1$.

2. A starting device for a discharge lamp according to claim 1, characterized in that said bimetal switch circuit is provided along with said discharge tube in an envelope evacuated to a vacuum.

3. A starting device for a discharge lamp according to claim 1, characterized in that said bimetal switch circuit further includes a bimetal heating filament which is connected in series with said bimetal switch and said fixed resistance element.

4. A starting device for a discharge lamp according to claim 2, characterized in that said bimetal switch circuit further includes a bimetal heating filament which is connected in series with said bimetal switch and said fixed resistance element.

5. A starting device for a discharge lamp according to claim 1, characterized in that said discharge tube is filled with a metal or a metal halide for light emission in addition to mercury and a rare gas.

6. A starting device for a discharge lamp according to claim 1 wherein said fixed resistance element has a resistance of approximately 560 ohms.

7. A starting device for a discharge lamp according to claim 1 wherein said fixed resistance element is an oxide film or carbon film resistance.

* * * * *